United States Patent [19]

Higashi et al.

[11] Patent Number: 4,843,214

[45] Date of Patent: Jun. 27, 1989

[54] HEAT ROLL TYPE ARRANGEMENT FOR ELECTROSTATIC RECORDING APPARATUS

[75] Inventors: Yuitiro Higashi, Yokohama; Junji Nakai, Tokyo; Hidenori Kawabuchi; Yasuhisa Kato, both of Yokohama, all of Japan

[73] Assignee: Ricoh Company, Ltd., Tokyo, Japan

[21] Appl. No.: 191,056

[22] Filed: May 6, 1988

[30] Foreign Application Priority Data

May 7, 1987 [JP] Japan ..... 62-109729
Jul. 8, 1987 [JP] Japan ..... 62-168771

[51] Int. Cl.[4] ..... G03G 15/20

[52] U.S. Cl. ..... 219/216; 355/290; 355/309

[58] Field of Search ..... 219/216, 469, 470, 471; 355/3 FU, 3 SH; 162/270, 271

[56] References Cited

U.S. PATENT DOCUMENTS 4,355,881 10/1982 Tarumi ..... 219/216

4,525,057 6/1985 Kaufmann ..... 355/3 FU

FOREIGN PATENT DOCUMENTS 60-50568 3/1985 Japan ..... 355/3 FU

*Primary Examiner*—Teresa J. Walberg

*Attorney, Agent, or Firm*—Oblon, Fisher, Spivak, McClelland & Maier

[57] ABSTRACT

A heat roll type fixing arrangement for fixing a toner image on a paper includes an inlet guide plate which constitutes a lower guide plate for guiding the paper toward a nipping section of a fixing roll pair. Two ribs are provided in a central portion of a guide surface of the guide plate with respect to the widthwise direction of the guide surface. The front end of the guide plate is notched at opposite sides of the central portion such that it is sequentially inclined toward opposite side edges of the guide plate while sequentially approaching the nipping section. The guide plate is so arranged as to position the highest point of the tip of each rib which is closest to the nipping section in a predetermined spatial range.

5 Claims, 3 Drawing Sheets

HEAT ROLL TYPE ARRANGEMENT FOR ELECTROSTATIC RECORDING APPARATUS

BACKGROUND OF THE INVENTION

The present invention relates to a heat roll type fixing arrangement for an electrophotographic copier, laser printer, fascimile apparatus and other electrostatic recording apparatuses.

In an electrophotographic copier, for example, a toner image is produced on a photoconductive element by a predetermined process, then transferred to a paper, and then fixed on the paper. A predominant type of fixing device includes a fixing roll having a heater therein and a pressing roller pressed against the fixing roll to define a nipping section in cooperation with the fixing roll. A paper carrying a toner image thereon is moved through the nipping section so that the toner image is fused and thereby fixed on the paper. An inlet guide plate, or lower guide plate, and an upper guide plate are located to face each other for guiding the paper into the nipping section.

In a fixing device of the type described, while the paper is guided into thenipping section of the fixing and pressing rolls, it is apt to be creased in its opposite side portions and to curl upward in its trailing end portion. A toner image provided on a paper with such creases and/or curls is often disturbed. Some different approaches have been proposed to eliminate such an occurrence. One approach is using a generally hand-drum-like fixing roll whose diameter is slightly small at the center than at the opposite ends, so that a paper is prevented from being creased. Another approach is providing two ribs on a central part of a guide surface of an inlet guide plate such that the ribs individually extend in an intended direction of paper transport. When a paper is moved on and along the inlet guide plate, those ribs form folds in the paper in the transport direction to render the paper rigid and thereby prevents the trailing end portion of the paper from curling upward.

However, a problem with an inlet guide plate having the above configuration is that it fails to guide opposite side portions a paper of a relatively large size straightforward into the nipping section of the fixing and pressing rolls, i.e., the opposite side portions of such a paper abut against the periphery of the pressing roll and then enter the nipping section along the periphery of the pressing roll. In this condition, the side portions of the paper enter the nipping section slightly later than the central portion and are therefore creased. Further, when a post cart or like relatively thick and rigid paper is guided by the inlet guide plate toward the nipping section, the ribs deflect the leading end portion of the paper upward to prevent it from being accurately guided into the nipping section. This is apt to cause the paper to jam the transport path. It has been proposed to allow the inlet guide plate to selectively assume two different positions: a raised position adapted for an ordinary paper and in which the ribs protrude upward from the transport path, and a lowered position adapted for a post card or like relatively thick paper and in which the upper ends of the ribs are aligned with the paper transport path. This kind of scheme, however, adds to the cost of the fixing device. Although the distance between the front ends of the ribs and the inlet of the nipping section may be increased to admit even a relatively thick paper into the nipping section, the ribs raise the central portion of the paper above the opposite side portions and causes the former to abut against the fixing roll before the latter, again resulting in creases.

SUMMARY OF THE INVENTION

It is therefore an object of the present invention to provide a heat roll type fixing arrangement which prevents even a paper that is apt to curl, e.g., a paper of a relatively large size from being creased while fixing a toner image on the paper.

It is another object of the present invention to provide an inexpensive heat roll type fixing arrangement which frees a toner image from damage before it is fixed and prevents a post card or like relatively thick and rigid paper from jamming a transport path or from being creased.

It is another object of the present invention to provide a generally improved heat roll type fixing arrangement.

A heat roll type fixing arrangement for fixing a visible image provided on a paper by applying heat to the image of the present invention comprises fixing roll means for fixing the visible image on the paper which is moved along a predetermined paper transport path, pressing roll means pressed against the fixing roll means, the fixing roll means and pressing roll means constituting a nipping section, guide means constituted by an upper and a lower guide plate for guiding the paper into the nipping section, and curl preventing means provided in a central portion of a guide surface of the lower guide plate with respect to a widthwise direction of the guide surface for preventing a trailing end portion of the paper from curling. The lower guide plate has a front end which faces the nipping section and includes recessed portions each being formed by notching the lower guide plate at a respective one of opposite sides of the central portion and inclined portions each being formed by notching the lower guide plate such that each of the inclined portions individually extends from a respective one of the recessed portions to a respective one of opposite side edges of the lower guide plate while sequentially protruding toward the nipping section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
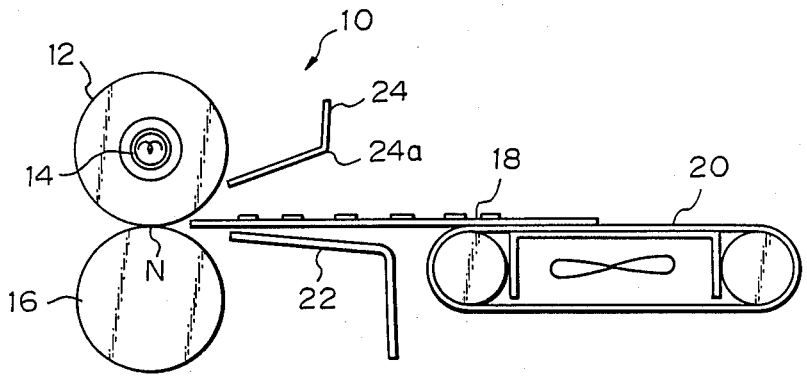
Fig. 1 PRIOR ART
FIG. 1 is a sectional side elevation showing a general construction of a heat roll type fixing arrangement.

To better understand the present invention, a brief reference will be made to a prior art heat roll type fixing arrangement, shown in FIG. 1. As shown, the arrangement 10 includes a fixing roll 12 in which a heater 14 is disposed, and a pressing roll 16 which is held in pressing contact with the fixing roll 12. A paper 18 carrying a toner image therein is driven through a nipping section N of the two rolls 12 and 16, whereby the toner image is fused and fixed on the paper 18. Specifically, the paper 18 to which a toner image has been transferred from a photoconductive element, not shown, is transported by a belt 20 toward the fixing arrangement 10 with its back being attracted by the belt 20. An inlet guide plate, or lower guide plate, 22 and an upper guide plate 24 which faces the lower guide plate 22 are located in front of the nipping section N to guide the paper 18 into the nipping section N.

Figure 2:
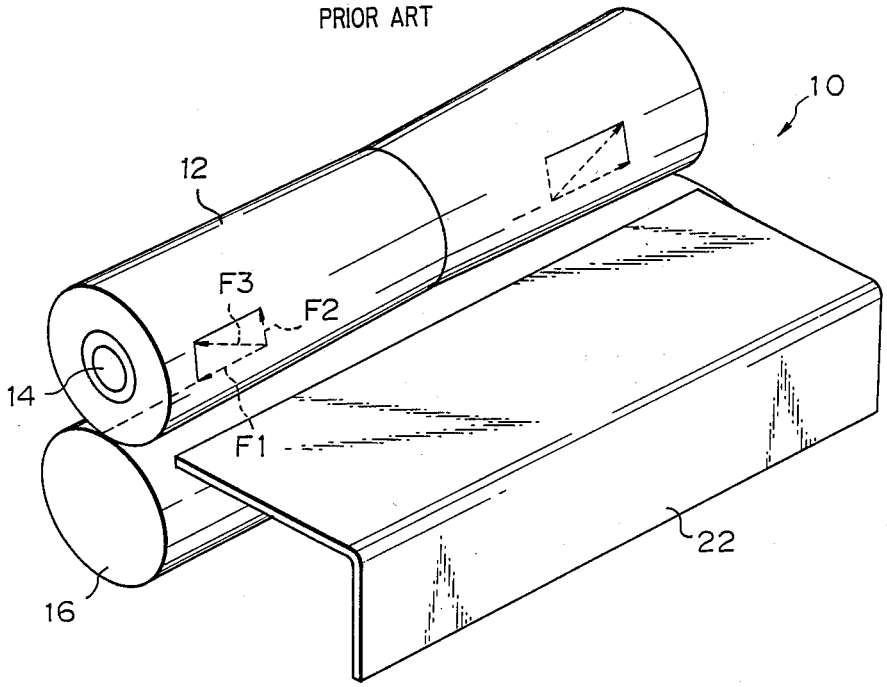
Fig. 2 PRIOR ART
FIG. 2 is a perspective view showing an example of prior art fixing arrangements of the type having an inlet guide plate and a hand-drum-like fixing roll.

FIG. 2 shows specific configurations of the inlet guide plate 22 and fixing roll 12. The fixing roll 12 is shown as having a diameter which is sequentially reduced from opposite ends toward the center. When the cylindrical pressing roll 16 is pressed against such a generally hand-drum-like fixing roll 12, a force F1 which stretches the paper 18 outward away from the center is applied to the paper 18 while the paper 18 is moved through the nipping section N. This prevents the paper 18 from being creased. At the same time, a reaction F2 acts perpendicularly on the periphery of the fixing roll 12 and is combined with the outward force F1. Due to the vector of a resultant F3, an obliquely upward force is applied to the paper 18 to cause a stress to accumulate in a trailing end portion of the paper 18, whereby the trailing end portion is curled upwardly at opposite sides thereof. Should such a curled end portion of the paper 18 rub against the bend of the upper guide plate 24, the toner image left unfixed on the paper 18 would be disturbed. While the bend of the upper guide plate 24 may be so configured as not to make contact with the paper 18, such a configuration is impractical due to positional limitations amd impairs the expected function of guiding the curled paper 18 into the nipping section N. Another implementation heretofore proposed is toothed spurs which are provided on that part of the upper guide plate 22 which may contact the paper 18. When the spurs are brought into contact with the paper 18, they are caused to roll and make contact with the paper 18 at the tips of their teeth. This implementation is not fully satisfactory because, as the toner sequentially accumulates on the tips of the teeth, smears resembling dotted lines are produced on images.

Figure 3:
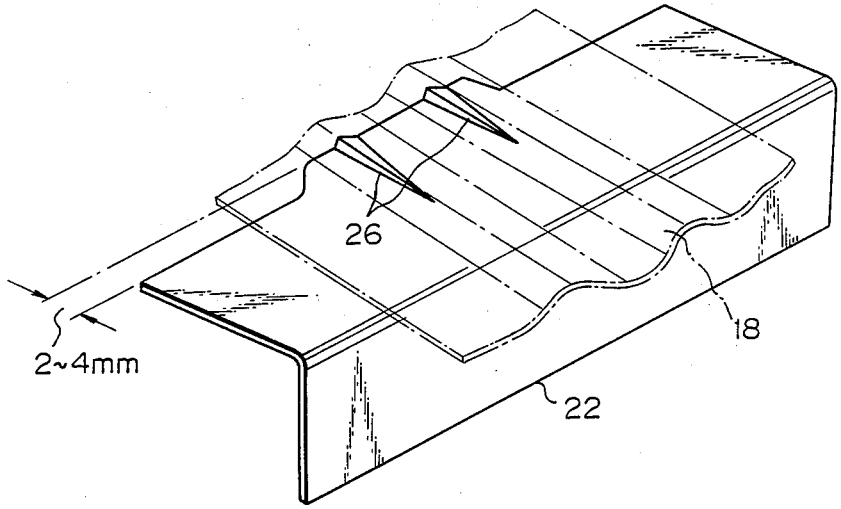
Fig. 3 PRIOR ART
FIG. 3 is a perspective view of a prior art inlet guide plate on which ribs are provided.

FIG. 3 shows a measure customarily adopted to prevent the trailing end of the paper 18 from being curled in relation to the hand-drum-like configuration of the fixing roll 12. As shown, ribs 26 are provided in a central part of the guide surface of the inlet guide plate 22 and each is dimensioned 0.5 to 1.5 millimeters high. While the paper 18 is moved on and along the ribs 26 by the rollers 12 and 16, it is formed with folds in the intended direction of paper transport. The folds serve to counteract the force which tends to curl the paper 18 upward. The inlet guide plate 22 may be notched at opposite sides of the central part where the ribs 26 are positioned such that the front ends of those notched parts are recessed by 2 to 4 millimeters. This configuration will facilitate folding of the paper 18 and therefore enhance the prevention of upward curling. By experiments, it is known that an upper guide plate without such notches is poorer in effect by 30 to 50 percent than a plate with notches.

The configuration of the inlet guide plate 22 shown in FIG. 3 has a drawback, however. Assume that the paper 18 driven into the nipping section N is a paper having a relatively large size or a paper undergone the first copying process of a two-side copy mode or that of a combination copy mode, such papers being apt to hang down at opposite sides thereof. Then, opposite side portions of the paper 18 do not advance straightforward toward the nipping section N, i.e., they abut against the periphery of the pressing roll 16 and then advance therealong into the nipping section N. Consequently, the side portions of the paper tend to enter the nipping section N later than the central portion to be thereby creased.

Further, when the inlet guide plate 22 is provided with the ribs 26 as stated above, a post card or like relatively thick and rigid paper is apt to be oriented upward by the ribs 26 and fail to enter the nipping section N of the rolls 12 and 16 to jam the transport path. To solve this problem, an arrangement has been proposed in which the inlet guide plate 22 is movable between two different positions. Specifically, when the paper 18 is an ordinary paper, the guide plate 22 is positioned such that the ribs 26 protrude upward from the paper transport path which extends from the belt 20 toward the nipping section N. oN the other hand, when the paper 18 is a post card or like relatively thick and rigid paper, it is positioned such that upper ends of the ribs 26 are aligned with the paper transport path. However, this kind of arrangement requires an extra cost. Although the distance between the front ends of the ribs 26 and the nipping section N may be increased to allow even a relatively thick paper to enter the nipping section N, this causes the ribs 26 to raise the central portion of the paper relative to the opposite side portions. In this condition, the central portion abuts against the fixing roll 12 earlier than the side portions resulting in creases.

Figure 4:
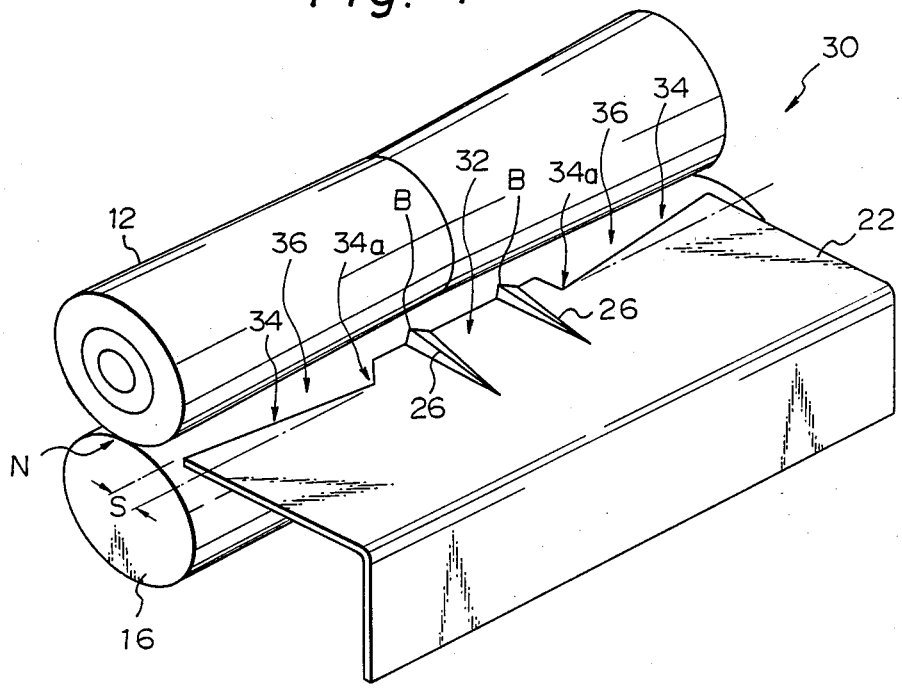
FIG. 4 is a perspective view showing a heat roll type fixing arrangement embodying the present invention.
Figure 5:
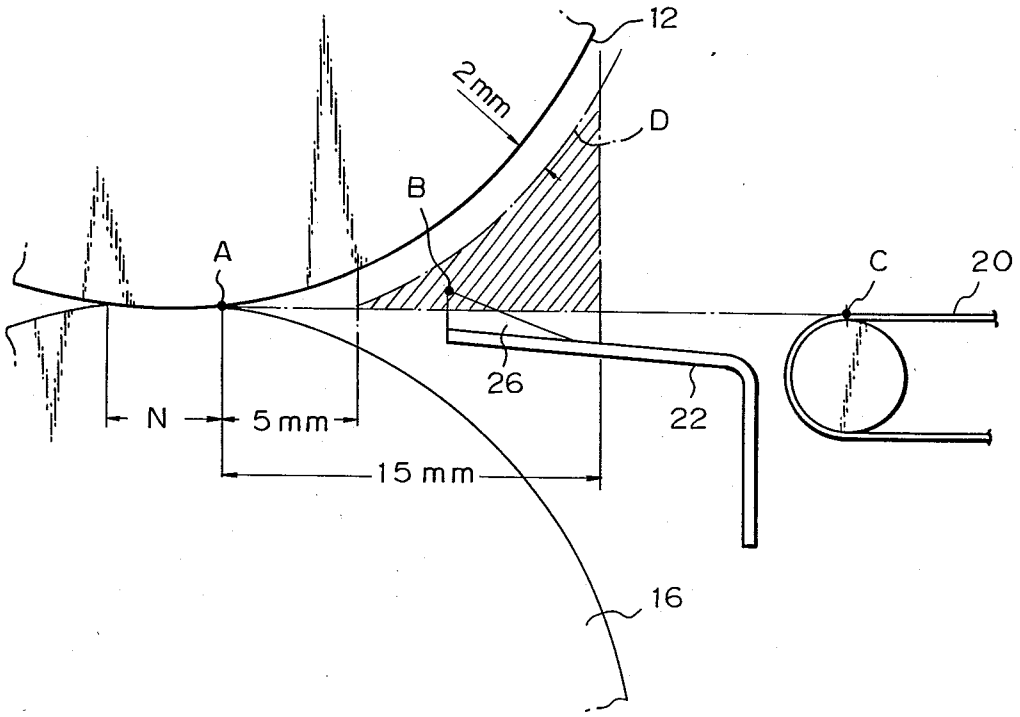
FIG. 5 is a schematic diagram representative of a preferable range in which ribs in accordance with the present invention may be positioned.

Referring to FIGS. 4 and 5, a heat roll type fixing arrangement embodying the present invention is shown and generally designated by the reference numeral 30. In these figures, the same or similar structural elements as those shown in FIGS. 1 to 3 are designated by like reference numerals. The arrangement 30, like the prior art arrangement 10, includes an inlet guide plate 22, a fixing roll 12, and a pressing roll 16. The fixing roll 12 has a generally hand-drum-type configuration which is effective in preventing creases. The pressing roll 16 is pressed against the underside of the fixing roll 12. The inlet guide plate 22 adapted to guide a paper 18 into a nipping section N of the rolls 12 and 16 is provided with ribs 26 in a central portion 32 of its paper guide surface. The ribs 26 serve to prevent the trailing end portion of a paper 18 from being curled upward. The guide plate 22 is notched at opposite sides of the central portion 32 such that the front ends 34 of the notched side portions are recessed relative to the central portion 32. The construction described so far is the same as that of the prior art arrangement 10.

In accordance with the present invention, the front end 34 of the inlet guide plate 22 is recessed at opposite sides of and away from of the central portion 32 and then sequentially protruded toward the opposite ends of the guide plate 22, thereby defining notches 36. In this configuration, the ribs 26 and recessed portions 34a of the plate front end 34 cooperate to fold the paper sheet 18 so as to provide the latter with elasticity. This prevents the paper 18 from rubbing against an upper guide plate 24 which is not shown in FIGS. 4 and 5. Another characteristic feature of the present invention is that the front ends 34 of the guide plate 22 located at opposite sides of the central portion 32 are individually so inclined as to sequentially protrude forward toward the opposite ends of the guide plate 22, i.e., the opposite end portions of the guide plate 22 are positioned close to the nipping section N of the roll 12 and 16. Hence, even when the paper 18 is curled such that its opposite end portions hang down, those opposite end portions are prevented from entering the nipping section N later than the central portion. Consequently, the paper 18 is free from creases otherwise produced by curling.

Advantageously, the amount of protrusion S of the inclined portion which is included in the front end 34 of the guide plate 22 as measured from the recessed portion 34*a* is 1 to 5 millimeters for layout reasons, e.g. prevention of contact with the pressing roll 16. Experiments showed that the arrangement 30 of the present invention is comparable with the prior art arrangement 10 with regard to the prevention of rubbing of an image surface and, in addition, reduces the creasing ratio of a paper having a relatively large size to less than 1 percent which is a remarkable improvement over the ratio of 5 to 10 percent particular to the prior art arrangement 10.

FIG. 5 shows a preferable range of levels at which the highest point B of each rib 26 may be positioned. This range is determined as follows.

The prevention of an occurrence that the trailing end portion of the paper 18 rubs against the upper guide plate 24 due to curling is a first consideration. When the highest point B of each rib 26 on the guide plate 22 is located below an imaginary line which interconnects a point C where the paper 18 leaves the belt 20 and an inlet point A of the nipping section N, the ribs 26 to not contribute to folding of the paper 18 at all. In this condition, the paper 18 is apt to curl at its trailing end portion and rub a toner image against a bend 24*a* of the upper guide plate 24. For this reason, the highest point B of each rib 26 has to be positioned above the line which interconnects the inlet A of the nipping section N and the point C where the paper 18 leaves the belt 20 (usually the highest point of a transport path). While the point B of each rib 26 should be located above the line AC for folding purpose as stated above, it preferably should not protrude from the line AC as far as possible when it comes to the prevention of the jam of a post card or the like thick paper. It was found by experiments that a jam is apt to occur when the clearance between such a paper and the fixing roll 12 is less than 2 millimeters. Hence, the point B has to be located below a curve D which is spaced 2 millimeters from the surface of the fixing roll 2.

The creasing ratio is reduced if the paper 18 is surely fed to the inlet point A of the nipping section N; even if the paper 18 is curled in the widthwise direction, the creasing ratio is successfully reduced so long as its central portion and opposite side portions are fed into the section N evenly and substantially at the same time. In this regard, the distance between the points B and A should preferably be short. However, if this distance is exessively short, a thick paper such as a post card will be deflected upward by the ribs 26 to fail to enter the nipping section N. Experiments proved that a preferable distance between the point B to A is 5 to 15 millimeters.

It follows from the above considerations that the highest point B of each rib 26 should preferably be positioned within the range which is indicated by hatching in FIG. 5, i.e., the range defined by (a) the line AC interconnecting the inlet point A of the nipping section N and the point C where the paper 18 leaves the belt 20, (b) the curve spaced 2 millimeters from the periphery of the fixing roll 12, (c) a vertical line spaced 5 millimeters to the rear from the inlet point A, and (d) a vertical line spaced 15 millimeters to the rear from the inlet point A.

In summary, it will be seen that the present invention provides a heat roll type fixing arrangement which prevents a trailing end portion of a paper from curling upward with a simple and therefore inexpensive construction. In addition, the arrangement of the invention allows a minimum of creasing to occur at opposite side portions of a paper having a relatively large size although those opposite side portions may hang down due to such a paper size.

Further, in accordance with the present invention, ribs for preventing a trailing end portion of a paper from curling are provided on a guide surface of an inlet guide plate such that the highest point of each rib lies in a particular range which reduces rubbing of an image against the guide plate, jamming of a post card and other relatively thick papers, and creasing of a paper.

Various modifications will become possible for those skilled in the art after receiving the teachings of the present disclosure without departing from the scope thereof.

What is claimed is:

1. A heat roll type fixing arrangement for fixing a visible image provided on a paper by applying heat to the image, comprising:

fixing roll means for fixing the visible image on the paper which is moved along a predetermined paper transport path;

pressing roll means pressed against said fixing roll means, said fixing roll means and said pressing roll means constituting a nipping section;

guide means constituted by an upper and a lower guide plate for guiding the paper into the nipping section; and curl preventing means provided in a central portion of a guide surface of the lower guide plate with respect to a widthwise direction of said guide surface for preventing a trailing end portion of the paper from curling;

said lower guide plate having a front end which faces the nipping section and includes recessed portions each being formed by notching said lower guide plate at a respective one of opposite sides of the central portion and inclined portions each being formed by notching said lower guide plate such that each of said inclined portions individually extends from a respective one of said recessed portions to a respective one of opposite side edges of said lower guide plate while sequentially protruding toward the nipping section.

2. A fixing arrangement as claimed in claim 1, wherein the end of each of the inclined portions of said lower guide plate which is closest to the nipping section is protruded by 1 to 5 millimeters relative to said recessed portion.

3. A fixing arrangement as claimed in claim 1, wherein said curl preventing means comprises a plurality of rib members each being sequentially protruded upward as said rib member approaches the nipping section.

4. A fixing arrangement as claimed in claim 3, wherein the highest point of each of the ribs is positioned in a predetermined spatial range.

5. A fixing arrangement as claimed in claim 4, further comprising a transport member for transporting the paper, the predetermined range being defined above a line interconnecting an inlet point of the nipping section and a point where the paper leaves said transport member, spaced 2 millimeters outward from a surface of said fixing roll means, and spaced more than 5 millimeters and less than 15 millimeters rearward from said inlet point in an intended direction of paper transport.

* * * * *